US005367851A

United States Patent [19]

Larson

[11] Patent Number: 5,367,851

[45] Date of Patent: Nov. 29, 1994

[54] PANEL SPACER AND JOINT

[76] Inventor: Jerry B. Larson, 670 N. Apache Dr., Chandler, Ariz. 85224

[21] Appl. No.: 160,220

[22] Filed: Dec. 2, 1993

[51] Int. Cl.[5] ..... E04C 3/00

[52] U.S. Cl. ..... 52/585.1

[58] Field of Search ..... 52/585.1, 586.2, 573.1, 52/588, 580

[56] References Cited

U.S. PATENT DOCUMENTS

| | | | |
|---|---|---|---|
| 2,235,646 | 3/1941 | Schaffer | 52/585.1 |
| 2,681,483 | 6/1954 | Morawetz | 52/585.1 |
| 3,884,002 | 5/1975 | Logie | 52/585.1 X |
| 4,196,554 | 4/1980 | Anderson et al. | 52/588.1 X |
| 4,474,493 | 10/1984 | Welch | 52/585.1 X |

FOREIGN PATENT DOCUMENTS

| | | | |
|---|---|---|---|
| 2733311 | 2/1979 | Germany | 52/585.1 |

*Primary Examiner*—Carl D. Friedman
*Assistant Examiner*—Creighton Smith

[57] ABSTRACT

A simple yet high-tech panel spacer and joint are provided. The spacer, having a bi-frustum shape, is formed of a resilient, durable material and can be conveniently installed between panels such as used in wooden doors to stop rattles and cracks in the joints as the panels expand and contract due to heat, moisture or the like.

10 Claims, 2 Drawing Sheets

PANEL SPACER AND JOINT

BACKGROUND OF THE INVENTION

1. Field of the Invention

The invention herein pertains to panel spacers which are used with wooden panels in such applications as paneled doors and particularly pertains to resilient spacers to prevent squeaks between panels and to provide a tight joint.

2. Description of the Prior Art And Objectives of the Invention

Wooden paneled doors have become increasingly popular with homeowners and builders in recent years causing a greater demand for spacers which are positioned between the panels in the connecting joints. Such spacers are used for centering solid panels, preventing panel rattle, and preventing cracking glue joints by taking up space between panels and providing frictional surfaces to immobilize the joints. Conventional spherical panel spacers are currently available which are resilient but only provide minimal surface contact along the edges of the panels when compressed. Such limited contact area provides, correspondingly, only limited friction to effect the purposes for which the older spherical spacers are used.

Thus, with the problems and disadvantages of prior art panel spacers, the present invention was conceived and one of its objectives is to provide a superiorly shaped resilient panel spacer to improve the effect and purposes of the spacer.

It is another objective of the present invention to provide a panel spacer that allows a wider contact surface when compressed and, correspondingly, more friction between the edges of the panels than does the old spherically shaped spacer.

It is yet another objective of the present invention to provide a panel spacer, the frictional surface area of which increases with increased compression.

It is also an objective of the present invention to provide a bi-frustum shaped panel spacer that more effectively centers panels and more effectively prevents panel rattle than does a spherically shaped spacer.

It is another objective of the present invention to provide a panel joint utilizing the bi-frustum spacer in combination with the panels.

Various other objectives and advantages of the present invention will become apparent to those skilled in the art as a more detailed description is set forth below.

SUMMARY OF THE INVENTION

The aforesaid and other objectives are realized by providing a resilient panel spacer with a bi-frustum shape. A pair of frusto-conically shaped members are joined end to end at the large ends of one another to provide a spacer with increased length and contact area in combination with two wooden panels in a joint such as found in a wooden paneled door.

DESCRIPTION OF THE PREFERRED EMBODIMENT

Figure 2:
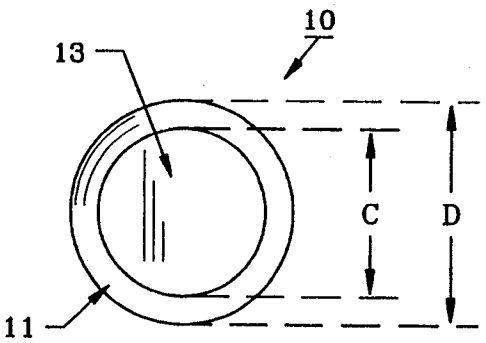
FIG. 2 shows an enlarged end view of one of the frustums as seen in FIG. 1.
Figure 1:
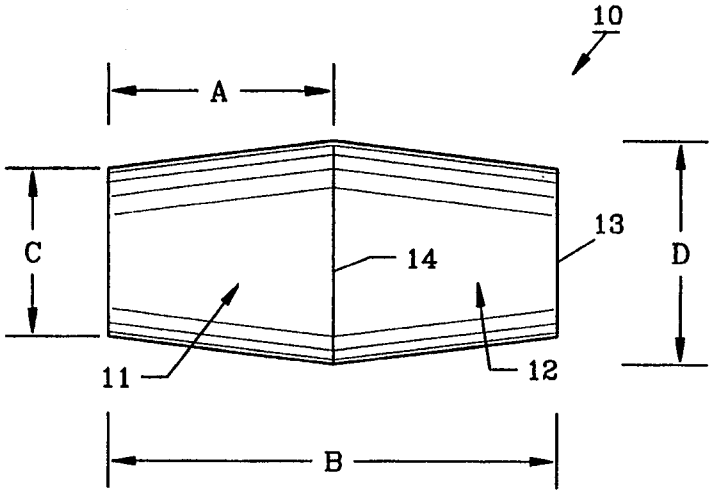
FIG. 1 illustrates a side view of a bi-frustum panel spacer of the invention.
Figure 3:
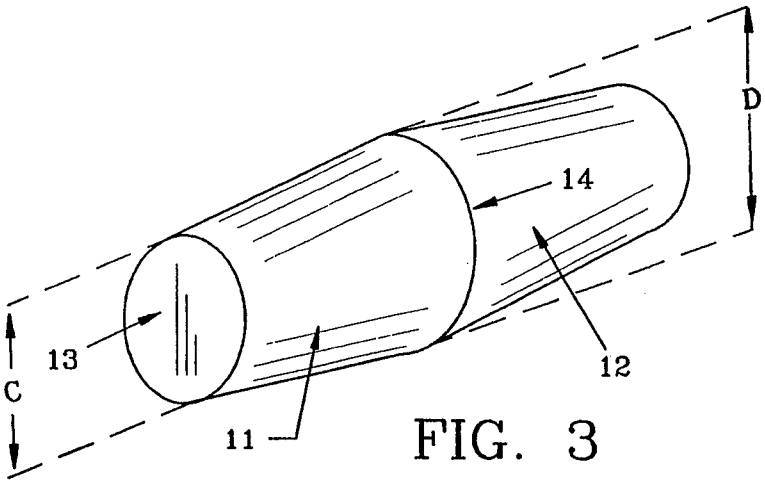
FIG. 3 demonstrates a perspective view of the bi-frustum panel spacer.
Figure 5:
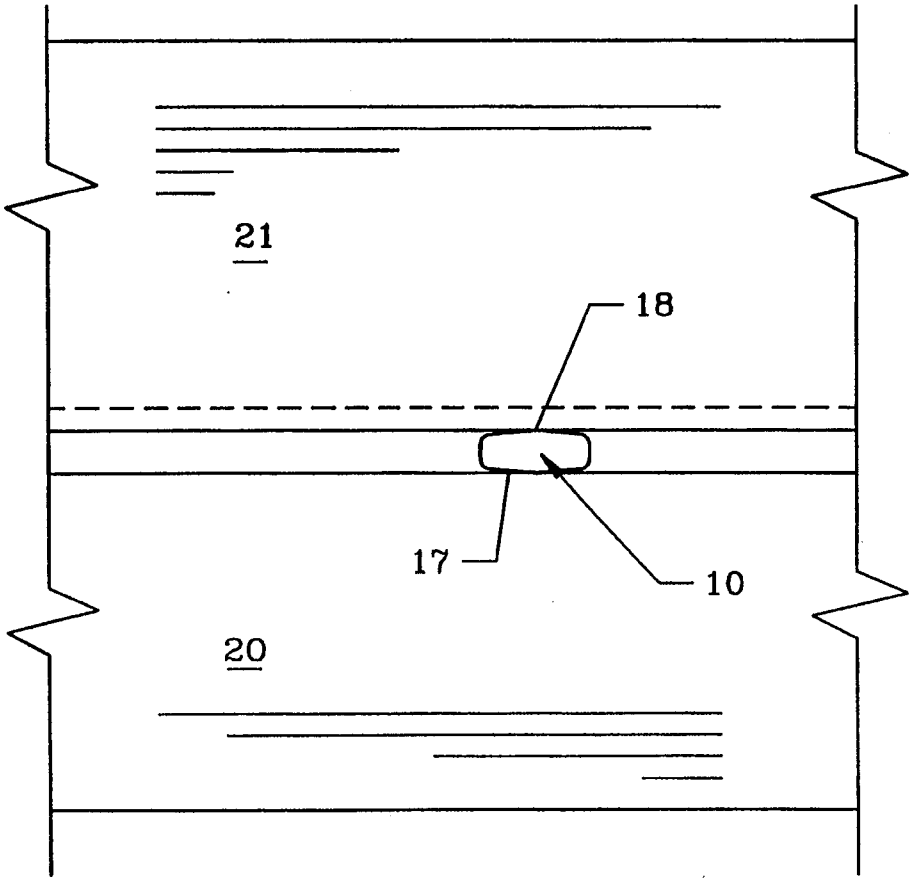
FIG. 5 depicts the joint of FIG. 4 seen along the longitudinal axis thereof with the bi-frustum spacer in a compressed state, viewed along one side.
Figure 4:
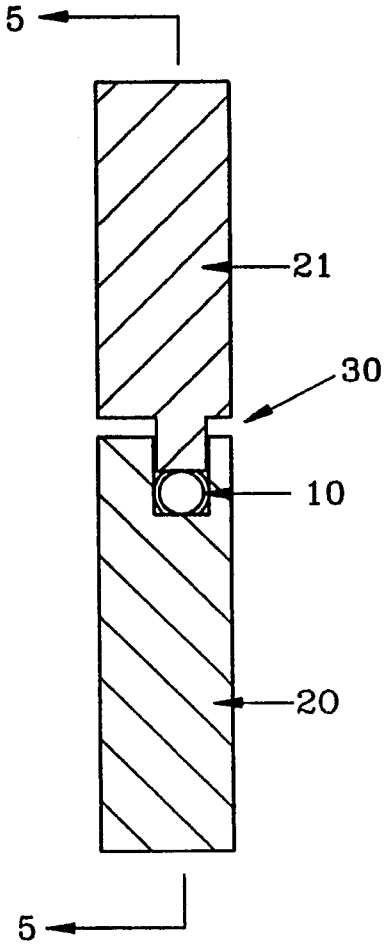
FIG. 4 pictures a cross-sectional end view of a joint formed from two wooden panels with a bi-frustum panel spacer compressed therebetween.

The preferred form of the panel spacer of the invention is shown in FIGS. 1–3 having a bi-frustum, conical shape. FIGS. 4 and 5 show the bi-frustum panel spacer being used between two panels such as in a paneled door joint. As seen, the preferred shape of the bi-frustum panel spacer has two identically sized conical frustums joined together, end-to-end, at the larger of the two ends. The comparative dimensions of the preferred bi-frustum spacer are such that the minor diameters (at the terminal ends of the spacer) are a shorter length than the axial length of either of the frustums and the major diameter (at the large end of the frustums) is also shorter in length than the axial length of the bi-frustum panel spacer. The preferred size of a bi-frustum panel spacer is slightly wider than the width of the groove that the spacer will be used in so as to insure a snug fit but yet retain optimal resiliency. For example, a wooden panel with a one-quarter inch (0.250″) groove would accommodate a bi-frustum panel spacer with a major diameter of approximately 0.265″ and an axial length of approximately one-half inch (0.500″). The bi-frustum panel spacer is preferably constructed of a resilient, polymeric material such as what is known in the trade as "40 shore" (natural rubber) with the following specifications: specific gravity: 1.01; tensile strength: 3,405 psi; elongation: 707%; tear: 152 ppi as are commonly used.

DETAILED DESCRIPTION OF THE DRAWINGS AND OPERATION OF THE INVENTION

For a better understanding of the invention and its use, turning now to the drawings, FIG. 1 illustrates a side view of bi-frustum panel spacer 10 with line A illustrating the axial length of one frustum 11 and line B illustrating the axial length of entire panel spacer 10. Line C shows the minor diameter of spacer 10 (which is the diameter of small end 13 of frustum 11) and line D depicts the major diameter of panel spacer 10 (which is the diameter of large end 14 of both frustums 11, 12).

FIG. 2 presents an enlarged end view for clarity of bi-frustum conical panel spacer 10 which may be formed of a durable resilient polymeric material. Line C being the aforementioned minor diameter and line D being the aforementioned major diameter as earlier described. In panel spacer 10, minor diameter C is greater than one-half the length of major diameter D and in FIG. 3 a perspective view of bi-frustum panel spacer 10 is seen to help illustrate the overall configuration.

As seen in FIG. 4 a combination of bi-frustum spacer 10 with wooden panels 20, 21 demonstrates typical joint 30 which does not rattle or squeak since (compressed) spacer 10 will expand as panels 20, 21 contract and spacer 10 will compress as panels 20, 21 expand.

As further seen in FIG. 5, when compressed by wooden panels 20, 21, elongated bi-frustum panel spacer 10 provides an increased frictional surface area along its length for contact with wooden panels 20, 21 than previously available spherical panel spacers would provide since a greater length-to-width ratio is provided than with spherical spacers. In addition, as opposed to a flat-surfaced panel spacer, the frictional surface area of panel spacer 10 increases with increased compression. Thus, problems caused by the slipping of old, spherical panel spacers due to insufficient friction generation are eliminated. Upon compression by panels 20, 21 it can be seen that bi-frustum panel spacer 10 is compressed such that nearly its entire axial length creates frictional surfaces 17, 18 for contact with wooden panels 20, 21. This contact, which increases as the wooden panels expand, retards the panel expansion to a limited degree. The compressed spacer 10 expands as the wooden panels contract to prevent rattling and loose panels which are annoying to the owner.

The illustrations and examples provided herein are for explanatory purposes and are not intended to limit the scope of the appended claims.

I claim:

1. A panel spacer comprising:

(a) a frustum having one end with a minor diameter and another, larger end with a major diameter;

(b) a second frustum having one end with a minor diameter and another, larger end with a major diameter the same as the major diameter of said first frustum, said frustums axially aligned and directly joined one to the other at the larger ends, said pair of frustums formed from a resilient material.

2. The spacer as claimed in claim 1 wherein said frustums are frusto-conically shaped.

3. The spacer as claimed in claim 2 wherein said frustums.

4. The spacer as claimed in claim 1 wherein said spacer has an axial length longer than the major diameter of said frustums.

5. The spacer as claimed in claim 1 wherein said frustums are formed of natural rubber.

6. The spacer as claimed in claim 1 wherein said spacer comprises a frictional surface area, said frictional surface area increasing with increased planar compressional force upon said spacer.

7. A joint comprising in combination:

(a) a first panel, said first panel defining a groove;

(b) a second panel, said second panel received within said groove; and (c) a spacer, said spacer comprising a pair of frustums, said frustums axially aligned and directly joined one to the other at large ends thereof, said spacer formed from a resilient material, said spacer positioned in said groove in contact with said second panel.

8. The combination of claim 7 wherein said spacer is axially aligned parallel to said groove.

9. The combination of claim 7 wherein said spacer is compressed within said groove between said first panel and said second panel.

10. A spacer for use between wood panels comprising:

a pair of identical frustums, said frustums axially aligned and directly joined one to the other at large ends thereof, said frustums being frusto-conically shaped, said frustums having minor diameters shorter than lengths of said frustums, said spacer having a major diameter less than an axial length of said spacer, said spacer formed from a resilient material.

* * * * *